United States Patent [19]

Krich et al.

[11] Patent Number: 4,469,259

[45] Date of Patent: Sep. 4, 1984

[54] BABY CARRIER

[76] Inventors: Claudia A. Krich; Keith Brinton, both of 203 Oak Ave., Woodland, Calif. 95695

[21] Appl. No.: 474,480

[22] Filed: Mar. 11, 1983

[51] Int. Cl.[3] ..... A47D 13/02

[52] U.S. Cl. ..... 224/160; 224/159; D3/31

[58] Field of Search ..... 224/158, 159, 160, 161; D3/31; D2/25; D21/189; 2/309, 311, 312

[56] References Cited

U.S. PATENT DOCUMENTS

| | | | |
|---|---|---|---|
| D. 252,958 | 9/1979 | Tatum | D3/31 |
| D. 253,558 | 12/1979 | Carter | D3/31 |
| D. 255,180 | 6/1980 | Raz | D3/31 |
| 542,306 | 7/1895 | Gaisman | 2/312 |
| 2,376,657 | 5/1945 | Chamberlain . | |
| 3,027,058 | 3/1962 | Huber . | |
| 3,097,773 | 7/1963 | Cunningham . | |
| 3,229,873 | 1/1966 | Hershman . | |
| 3,331,540 | 7/1967 | Higuchi . | |
| 3,421,670 | 1/1969 | Hansson . | |
| 3,481,517 | 12/1969 | Aukerman | 224/160 |
| 3,575,326 | 4/1971 | Chappell . | |
| 3,780,919 | 12/1973 | Hansson . | |
| 3,799,414 | 3/1974 | Fiffer . | |
| 3,871,562 | 3/1975 | Grenier . | |
| 4,009,808 | 3/1977 | Sharp . | |
| 4,037,764 | 7/1977 | Almosnino et al. . | |
| 4,139,131 | 2/1979 | Hathaway . | |
| 4,149,687 | 4/1979 | Nunemacher | 224/159 |
| 4,271,998 | 6/1981 | Ruggiano | 224/160 |

FOREIGN PATENT DOCUMENTS

| | | | |
|---|---|---|---|
| 5564 | of 1905 | United Kingdom | 2/311 |

*Primary Examiner*—Allan N. Shoap

*Attorney, Agent, or Firm*—Larson and Taylor

[57] ABSTRACT

A baby carrier which carries a baby facing in or out with equal comfort has a pouch panel connected at its upper edge to a shoulder strap and at its lower edge to a waist strap. After passing over the wearer's shoulders, the shoulder strap connects to middle straps which are attached to the sides of the pouch panel. The waist strap fits snugly, entirely around the wearer, such that the lower portion of the pouch panel extends outwardly from the waist strap to form the bottom support for the baby.

9 Claims, 7 Drawing Figures

BABY CARRIER

BACKGROUND OF THE INVENTION

This invention relates to a baby carrier, and in particular it relates to a non-rigid baby carrier of the type adapted to be worn by the person carrying the baby.

Baby carriers have been known heretofore for carrying a baby on the wearer's body, which carriers are formed of a flexible material and lack a rigid frame. Moreover, certain of these previously known carriers are constructed to carry the baby against the front of the wearer. These include U.S. Pat. Nos. 3,229,873 to Hershman, 3,780,919 to Hansson, 4,139,131 to Hathaway and 4,149,687 to Nunemacher.

However, these previous carriers, while satisfactory for their intended purposes, do not satisfy many requirements which the applicants herein have found to be desirable for a non-rigid baby carrier of the type adapted to be worn by the person carrying the baby. For example, applicants have found it desirable to provide a baby carrier which will hold a baby facing inward or outward, with equal comfort, ease of use and with the correct orthopedic effects for both the baby and the wearer.

Hence, the applicants have found that a need existed for a new and improved baby carrier of the non-rigid type which achieves certain advantages which could not be achieved with the baby carriers as known heretofore.

SUMMARY OF THE INVENTION

Hence, it is a purpose of the present invention to provide a baby carrier of the non-rigid type, and worn by the person carrying the baby, which achieves the new and improved results of holding a baby facing inward or outward, with equal comfort, ease of use and with the correct orthopedic effect for both the baby and the wearer.

The purpose of the present invention is achieved by providing a baby carrier having a pouch panel, a shoulder strap connected to the upper edge thereof, a waist strap connected to the lower edge thereof, and intermediate straps extending outwardly from both sides of the pouch panel and adapted to be connected to the shoulder straps after the shoulder straps have passed over the shoulders and back of the wearer. In this arrangement the waist strap fits snugly onto the wearer, around his or her entire circumference, such that the lower pouch portion extends forward from the waist strap to form a lower support for the baby, with the baby's leg passing out over the sides of the lower portion, outward from the waist strap.

According to preferred features of the present invention, the connecting means for connecting the various straps together are simple rings such as pairs of "O" rings or "D" rings which can be easily connected and disconnected. These attachments can be easily tightened or loosened by the wearer without removing the baby from the carrier. The pouch would preferably be made of a strong cloth material, such as canvas, denim, corduroy, or the like. The various straps are preferably relatively wide and may be formed of a strong webbed material of the type used in a webbed belt, or they can be formed of the same material which forms the pouch, but padded and quilted for greater strength and comfort.

Since the pouch panel and all of the straps are of a flexible cloth material, the baby carrier is lightweight and easily foldable to a compacted size.

In accordance with another feature of the invention, the pouch panel is connected to the lower edge of the shoulder strap and to the upper edge of the waist strap.

With the above described features of the present invention, there is provided a baby carrier which can hold a baby facing outward or inward with equal comfort, ease of use and with correct orthopedic effects on both the baby and the wearer. Specifically, since the lower pouch portion curves in under the baby toward the wearer before its attachment to the waist strap, said lower portion forms a support for the baby, permitting the baby's legs to extend outward over the sides of said lower portion, outward from the waist strap. Because of this arrangement, the baby will be equally comfortable whether facing inward toward the wearer or outward away from the wearer. Such flexibility is extremely advantageous because a very young baby needs to face inward for body and head support and emotional security while a slightly older baby needs to face outward for stimulation and pleasure. In addition, with the present baby carrier and with the baby facing inward, breast feeding of the baby may be accomplished. Whether facing inward or outward, the shoulder straps have a secondary use as lateral head supports for the baby.

An important feature of the present invention is that it achieves the above described advantages while having correct orthopedic effects on both the baby and the wearer. Several structural features of the present invention contribute to this result. First, there is a three-point connection to each side of the pouch panel. The upper two connections distribute the weight of the baby on the wearer's shoulders and upper back since the shoulder straps are attached not to the lower waist strap but to the intermediate strap spaced above the waist strap. In cooperation therewith, the waist strap contributes to good weight distribution since the waist strap fits snugly against the wearer around its entire circumference. In addition, the proximity of the baby to the wearer's body when facing inward, and the breadth and contour of the pouch panel when the baby faces outwad, both allow the baby to assume a semi-seated position with legs well apart, thus ensuring secure seating of the hip-joints, which is not achieved if the legs are allowed to hang straight. The three points of attachment on each side of the pouch panel ensure that a small baby cannot fall out of the side of the carrier.

Hence, it is an object of the present invention to provide a new and improved non-rigid baby carrier of the type adapted to be worn by the person carrying the baby.

It is another object of the present invention to provide a new and improved baby carrier capable of carrying a baby facing inward or outward with equal comfort and with favorable orthopedic effects.

It is still another object of the present invention to provide a new and improved non-rigid carrier of the type described having a three-point connection on each side, namely a shoulder strap which cooperates with a middle strap, and a waist strap, for properly orthopedically distributing the weight of the baby on the body of the wearer and for proper orthopedic positioning of the baby in the carrier.

These and other objects of the present invention will become more apparent from the detailed description to follow, taken together with the accompanying drawings.

BRIEF DESCRIPTION OF THE DRAWINGS

There follows a detailed description of preferred embodiments of the present invention which is intended to be read together with the accompanying drawings in which.

DETAILED DESCRIPTION OF THE PREFERRED EMBODIMENTS

Figure 1:
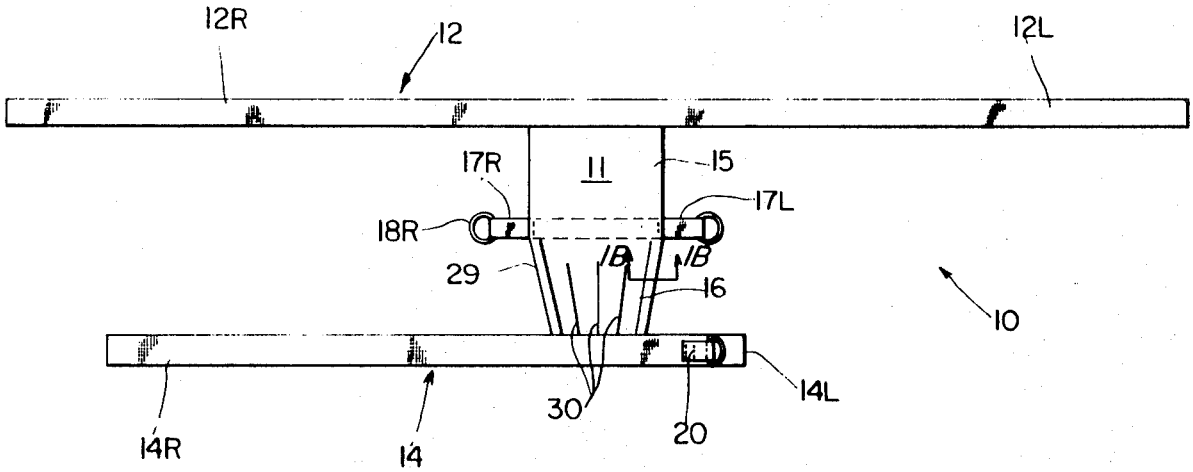
FIG. 1 is a front elevational view of a baby carrier of the present invention, opened up into a flat state prior to its being mounted onto the wearer.

Referring now to the drawings, like elements are represented by like numerals throughout the several views.

Figure 1A:
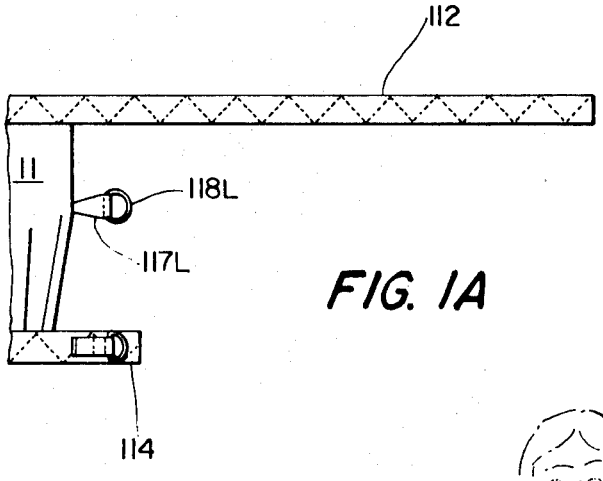
FIG. 1A is a partial front elevational view, similar to FIG. 1, but showing a variation of the embodiment shown in FIG. 1.
Figure 1B:
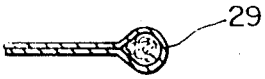
FIG. 1B is a partial cross-sectional view taken along line 1B—1B of FIG. 1.

FIG. 1 illustrates the baby carrier 10 of the present invention in its completely open essentially "flat" condition viewed from the front, i.e. as one would view the panel standing in front of the wearer. The carrier includes a pouch panel 11 having an upper, essentially flat portion 15 and a lower inwardly tapered portion 16. The tapered shape is achieved by tucking, puckering, or darting 30 the fabric of the lower part of the pouch panel so as to create a shallow convexity out of the plane of FIG. 1, the more securely to cradle the rounded body of a baby. Each edge of the lower, tapered portion of the pouch panel 16 is preferable padded, as shown in FIG. 1B with additional material between the layers of fabric of the pouch panel so as to create rounded edges 29 for the baby's legs to rest against. Along its upper edge, the panel 11, and in particular the upper flat portion 15 thereof, is connected to the lower edge of a shoulder strap 12. The side of shoulder strap 12 which passes over the wearer's right shoulder is designated as 12R and the portion which will pass over the wearer's left shoulder is designated as 12L.

The lower end of pouch panel 11, and in particular the lower end of tapered portion 16 thereof is connected along the upper edge of a waist strap 14. Once again, the portion of strap 14 which extends around the wearer's right side is designated as 14R while the portion which starts to wrap around the wearer's left side is designated as 14L.

Extending outward from each of the side edges of pouch panel 11 is a middle strap 17R and 17L, and connected to each of 17R and 17L is a conventional pair of O-rings 18R and 18L, respectively. 17R and 18R are of course located on the wearer's right side while 17L and 18L are located on the wearer's left side.

Figure 2:
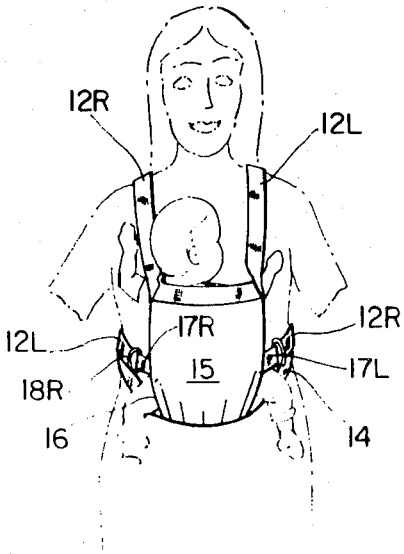
FIG. 2 is a front elevational view of the baby carrier of the present invention, mounted on the wearer, and illustrated in use supporting a small baby, facing inward.

Referring to FIG. 2, it is seen that the shoulder strap portions 12R and 12L pass over the wearer's shoulders, crossing over on the wearer's back. Hence, as seen in FIG. 2, the remote end of strap portion 12L is connected on the wearer's right side at O-ring 18R while the remote end of strap portion 12R is connected on the wearer's left side at O-ring 17L. The arrangement of the baby carrier, as mounted on the wearer, can be further understood by reference to FIG. 5 which is a side view of the baby carrier, as it would be positioned when holding a baby, but with the baby omitted for purposes of clarity. The crossover of the strap portions 12L and 12R is more apparent in FIG. 5.

In the embodiment shown in FIG. 1, all straps are formed of strong web material as used in web belts. The middle strap may be formed by passing a length of web material through the interior of the layers of fabric which form pouch 11, such that the ends of this length project out the sides of the pouch panel 11 to form the middle straps 17R and 17L. Alternatively, as shown in FIG. 1A, the belts may be formed of the same material as pouch 11, as shown at 112 and 114 but preferably padded and possibly quilted, for strength and comfort. As is also shown in FIG. 1A, the middle straps 17L and 17R (not visible in FIG. 1A) may be essentially triangular in shape with the narrowest portion provided at the connection of these strap portions 117 to the side edges of the panel 15. This modified construction allows the strap portions 117 to pivot vertically to better accommodate wearers of different heights without distorting the shape of the pouch panel.

Figure 5:
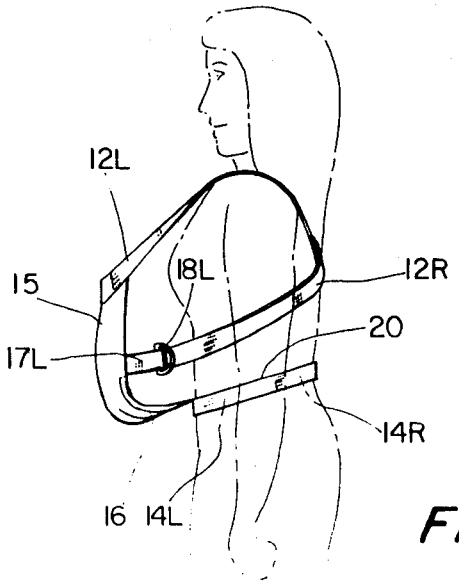
FIG. 5 is a side elevational view showing the baby carrier of the present invention mounted on the wearer, but with the baby omitted in order to show details of the invention.

Referring to FIG. 5, it can be seen that the waist strap 14 fits snugly against the wearer about his or her entire circumference, and most notably at the front thereof. This draws the lower portion 16 upward toward its connection with the upper edge of strap 14.Consequently, the lower tapered portion 16 of the pouch 11 forms a lower support for the baby, permitting the baby's legs to extend outward across the padded side edges of pouch portion 16, outwardly from the waist strap 14.

Figure 3:
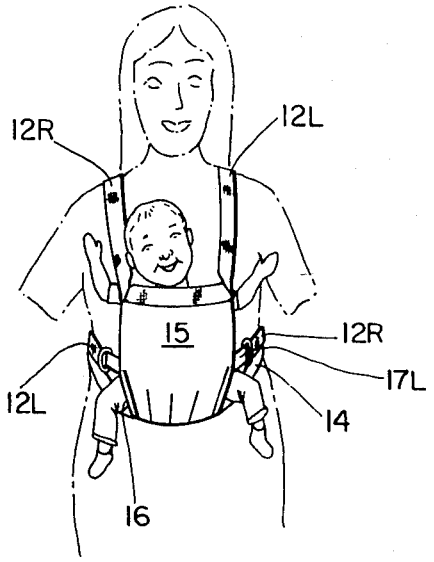
FIG. 3 is a front elevational view of the baby carrier of the present invention, mounted on the wearer, and illustrated in use supporting a small baby, facing outward.
Figure 4:
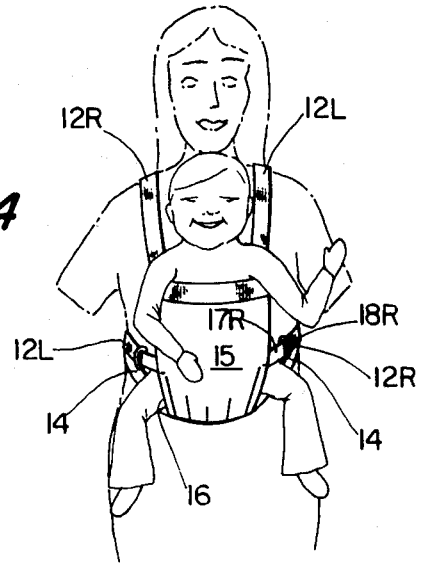
FIG. 4 is a front elevational view of the baby carrier of the present invention, mounted on the wearer, and illustrated in use supporting a larger baby, facing outward.

FIGS. 2–4 illustrate the versatility of the present invention. FIG. 2 illustrates the present baby carrier carrying a relatively small baby facing inwardly. The baby's arms pass under the strap portions 12R and 12L while these strap portions provide lateral head supports for the baby. As will be evident by referring to FIG. 5, the baby's legs pass over the padded side edges of lower panel portion 16, forward and outward from the waist strap 14.

FIG. 3 illustrates the present invention for use with a small baby similar to the small baby shown in FIG. 2, but with the baby facing outward. Once again, the arms pass below the strap portions 12R and 12L which provide lateral supports for the head while the baby's legs pass over the padded edges of panel portion 16. FIG. 4 illustrates the present invention mounting a larger baby than that shown in FIGS. 2 and 3. In this case the lower panel portion 16 performs the same function of supporting the lower portion of the baby with the legs extending over the padded edges thereof. However, in this case the arms pass over the strap portions 12R and 12L; and with a baby of this size, lateral head supports are not necessary.

As can be ssen from FIGS. 1 or 1A, the present baby carrier is relatively simple in its construction. This feature, coupled with the lightweight nature of the baby carrier permits the carrier to be folded up into a compact light package for ease of transport when not in use.

The versatility of the present baby carrier is such that it has been found to work satisfactorily for babies from birth up to approximately thirty pounds. Since there is no cloth between the wearer and the baby, the device is cooler and lighter, and moreover this makes it easier to place the baby into the pouch and remove the baby from the pouch when the carrier is mounted on the wearer. Pairs of rings such as "D" rings or "O" rings have been found to be advantageous as compared with conventional knots since the latter are hard to tie, hard to adjust and can come untied easily, especially if pulled upon by an older child, whereas "D" ring or "O" ring fastenings can be adjusted easily, with one hand, along the entire available length of the straps. A sleeping baby can simple be laid down for a nap right on the pouch panel, and the connections can be easily opened without even awakening the baby.

Although the invention has been described in considerable detail with respect to preferred embodiments, it will be understood that the invention is capable of numerous modifications and variations, apparent to those skilled in the art, without departing from the spirit and scope of the invention.

We claim:

1. A baby carrier for carrying a baby against the front of the wearer's body, comprising a pouch panel, shoulder straps and a waist strap:

said pouch panel formed of flexible material and having a generally flat rectangular upper portion and an inwardly tapering lower portion, the inward taper of the lower portion continuing from its juncture with the upper portion to its intersection with said waist strap adjacent the end of said lower portion, the respective ends of the pouch panel being coterminous with the ends of the upper and lower portions, the generally rectangular flat upper portion terminating at a height which, in use, is generally midway between the wearer's waist and neck, said generally flat rectangular portion being short enough in width to form an opening between itself and the wearer's body for passage of a baby's arms out of the sides of the upper portion, between the side edges of the upper portion and the front of the wearer, the continuously inwardly tapering lower portion being short enough in width to allow a baby's legs to extend out and over the side edges thereof, whether the baby is facing inward toward the wearer or outward away from the wearer, shoulder straps connected to the upper end of the upper portion and of sufficient length to extend up and over the shoulders of the wearer, criss-cross on the wearer's back and reach first connecting means associated with the respective opposite sides of the pouch panel, said first connecting means located on the side edges of the pouch panel substantially at the juncture of the upper portion and the lower portion for connecting each shoulder strap which has criss-crossed over the wearer's back to the opposite side of the pouch panel, each said first connecting means being located at a height above said end of said lower portion which is high enough to allow the baby's legs to pass out over the respective side edges of the pouch panel below said first connecting means, and also low enough to assure that a substantial portion of the baby's weight is spread across the upper back of the wearer, the lower end of the pouch panel connected to the waist strap, such that said waist strap extends outwardly from the respective side edges of said lower portion, said waist strap including second connecting means for connecting opposite ends of the waist strap to each other with the straps fitting snugly entirely around the wearer's body independently of the shoulder straps and the first connecting means, such that the continuously tapering lower portion of the pouch panel extends outwardly from the wearer's body to form a lower support for the baby.

2. A baby carrier according to claim 1, wherein the side edges of the lower portion are padded.

3. A baby carrier according to claim 1, wherein the pouch panel and all of said straps are of a flexible material, whereby the baby carrier is lightweight and easily foldable to a compacted size.

4. A baby carrier according to claim 1, wherein the pouch panel is connected to the lower edge of the shoulder strap and to the upper edge of the waist strap.

5. A baby carrier according to claim 1, constructed to be opened up to an essentially flat condition, with the pouch panel and all straps in a common plane.

6. A baby carrier according to claim 1, wherein the shoulder strap is relatively wide, padded and quilted.

7. A baby carrier according to claim 1, wherein said first connecting means comprises middle straps connected to the side edges of the pouch panel and being relatively narrow at their respective connections to the side edges of the pouch panel, enlarging outwardly therefrom in width towards their outer ends, and being generally triangularly shaped.

8. A baby carrier according to claim 7, wherein the first connecting means further comprises a set of rings attached to the outer ends of the triangular shaped middle straps.

9. A baby carrier according to claim 1, wherein each of said first connecting means comprises a strap extending outwardly from the side of the pouch panel, and a set of rings attached to each strap end, whereby the shoulder strap connected to the opposite side of the pouch panel, after passing around the wearer's back, is connectable thereto.

* * * * *